United States Patent [19]

Byrne

[11] 4,246,959

[45] Jan. 27, 1981

[54] METHOD AND APPARATUS FOR ISOLATION OF EXTERNAL LOADS IN A HEAT EXCHANGER MANIFOLD SYSTEM

[75] Inventor: John P. Byrne, Westminster, Calif.

[73] Assignee: The Garrett Corporation, Los Angeles, Calif.

[21] Appl. No.: 955,116

[22] Filed: Oct. 26, 1978

[51] Int. Cl.[3] ..... F28F 7/00

[52] U.S. Cl. ..... 165/83; 165/165; 165/177

[58] Field of Search ..... 165/81, 82, 83, 175, 165/165, 177; 285/114, 226, 119; 60/39.32, 687

[56] References Cited

U.S. PATENT DOCUMENTS

| | | | |
|---|---|---|---|
| 1,882,085 | 10/1932 | Nelson | 165/81 |
| 2,787,124 | 4/1957 | Donahue | 165/81 X |
| 3,527,291 | 9/1970 | Neary et al. | 165/83 |
| 3,850,231 | 11/1974 | Creek | 165/83 |
| 3,916,871 | 11/1975 | Estes et al. | 165/81 X |
| 4,134,449 | 1/1979 | La Haye et al. | 165/83 |

FOREIGN PATENT DOCUMENTS 667144 11/1938 Fed. Rep. of Germany .

*Primary Examiner*—George T. Hall
*Attorney, Agent, or Firm*—Henry M. Bissell

[57] ABSTRACT

Methods and apparatus for isolating a heat exchanger core from external ducting coupled to the heat exchanger manifolds. A flexible metal bellows of the externally pressurized type is utilized at each juncture between the inlet and outlet air ducts and the associated integral core manifolds. Similar arrangements are provided at the opposite side of the heat exchanger core where blind ducts are incorporated for balancing of the compression load forces and for access to the manifolds for inspection and maintenance.

13 Claims, 3 Drawing Figures

METHOD AND APPARATUS FOR ISOLATION OF EXTERNAL LOADS IN A HEAT EXCHANGER MANIFOLD SYSTEM

INTRODUCTION

Heat exchangers incorporating apparatus of the present invention have been developed for use with large gas turbines for improving their efficiency and peformance while reducing operating costs. Heat exchangers of the type under discussion are sometimes referred to as recuperators, but are more generally known as regenerators. A particular application of such units is in conjunction with gas turbines employed in gas pipe line compressor drive systems.

Several hundred regenerated gas turbines have been installed in such applications over the past twenty years or so. Most of the regenerators in these units have been limited to operating temperatures not in excess of 1000° F., by virtue of the materials employed in their fabrication. Such regenerators are of the plate-and-fin type of construction incorporated in a compression-fin design intended for continuous operation. However, rising fuel costs in recent years have dictated high thermal efficiency, and new operating methods require a regenerator that will operate more efficiently at higher temperatures and possesses the capability of withstanding thousands of starting and stopping cycles without leakage or excessive maintenance costs. A stainless steel plate-and-fin regenerator design has been developed which is capable of withstanding temperatures to 1100° or 1200° F. under operating conditions involving repeated, undelayed starting and stopping cycles.

The previous used compression-fin design developed unbalanced internal pressure-area forces of substantial magnitude, conventionally exceeding one million pounds in a regenerator of suitable size. Such unbalanced forces tending to split the regenerator core structure apart are contained by an exterior frame known as a structural or pressurized strongback. By contrast, the modern tension-braze design is constructed so that the internal pressure forces are balanced and the need for a strongback is eliminated. However, since the strongback structure is eliminated as a result of the balancing of the internal pressure forces, the changes in dimension of the overall unit due to thermal expansion and contraction become significant. Thermal growth must be accommodated and the problem is exaggerated by the fact that the regenerator must withstand a lifetime of thousands of heating and cooling cycles under the current operating mode of the associated gas turbine engine which is started and stopped repeatedly.

Confinement of the extreme high temperatures in excess of 1000° F. to the actual regenerator core and the thermal and dimensional isolation of the core from the associated casing and support structure, thereby minimizing the need for more expensive materials in order to keep the cost of the modern design heat exchangers comparable to that of the plate-type heat exchangers previously in use, have militated toward various mounting, coupling and support arrangements which together make feasible the incorporation of a tension-braze regenerator core in a practical heat exchanger of the type described.

Heat exchangers of the type generally discussed herein are described in an article by K. O. Parker entitled "Plate Regenerator Boosts Thermal and Cycling Efficiency," published in The Oil & Gas Journal for Apr. 11, 1977.

BACKGROUND OF THE INVENTION

1. Field of the Invention

This invention relates to heat exchangers of the thin formed plate-and-fin type and, more particularly, to particular arrangements for joining the manifold sections of such heat exchanger cores to external ducting without undue loading on the core manifold structure.

2. Description of the Prior Art

The use of opposed piping members joined by bellows to a central pressurized member with the entire combination being structurally held together by tie rods between the opposed piping members is known in the prior art. The use of one or more bellows elements to accommodate structural displacement, as by thermal growth or pressure expansion, is also well known in the prior art, as exemplified by the disclosures of U.S. Pat. Nos. 2,787,124, 3,527,291, 1,882,085, 3,916,871, among others. A particular type of externally pressurized bellows is disclosed in the Greek U.S. Pat. 3,850,231. The aforementioned Neary et al U.S. Pat. No. 3,527,291 also discloses the inclusion of restraining rods in the form of U-bolts for limiting the axial expansion of the bellows element thereof. These disclosures are limited to the use of bellows couplings for axial expansion and are not intended or used for accommodating multi-dimensional variation or balancing of applied pressure loads in the manner of the present invention.

The German Pat. No. 667,144 appears to show various combinations of a bellows juncture member between opposed piping with a spring retaining structure for opposing axial expansion of the bellows and possibly non-axial bending or twisting of the bellows.

Externally pressurized bellows provide certain advantages over the more common and better known internally pressurized bellows for use in an expansion joint between piping or the like. The internally pressurized bellows exhibits a tendency to "squirm" as the internal pressure is increased or as bellows "stiffness" is reduced. Long before the bursting pressure of the bellows is reached, the bellows will tend to twist and buckle out of shape. Such bellows elements are limited to uses below the "squirm" pressure. The longer the bellows, the lower the squirm pressure, thus placing inherent limitations on the use of such members.

Where the expansion joint includes a housing communicating with the internal pressure but entirely surrounding the bellow, the tendency to squirm is eliminated. Such externally pressurized bellows are also known in the prior art and are commercially available.

SUMMARY OF THE INVENTION

In brief, particular arrangements in accordance with the present invention comprise externally pressurized bellows connected to the internal manifolds at opposite sides of a thin plate-and-fin heat exchanger core to allow thermal growth or movement of the heat exchanger core in three dimensions, lateral as well as axial, during high temperature operation and to eliminate the build up of excessive stress in the heat exchanger due to the external connections and internal connections and internal operating pressures. External containment and balancing of the tremendous internal pressure force loads in the manifold portion of the core (the "blow-off" loads) are achieved by the provision of opposed duct-and-flange connections at opposite sides of the core with the flanges being tied together by tie rods extending between them.

The methods employed in the design and fabrication of apparatus of the present invention involve the calculation of the various forces which may be applied between the heat exchanger core and the bellows element joining the core manifold to external ducting under worst case conditions and thereafter designing the bellows coupling members to develop a selected load on the heat exchanger for both normal and extraordinary conditions of operation. In accordance with an aspect of the invention, the mean annulus area of the externally pressurized bellows is selected to provide the desired loading of the core based on anticipated operating pressure and temperature effects.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
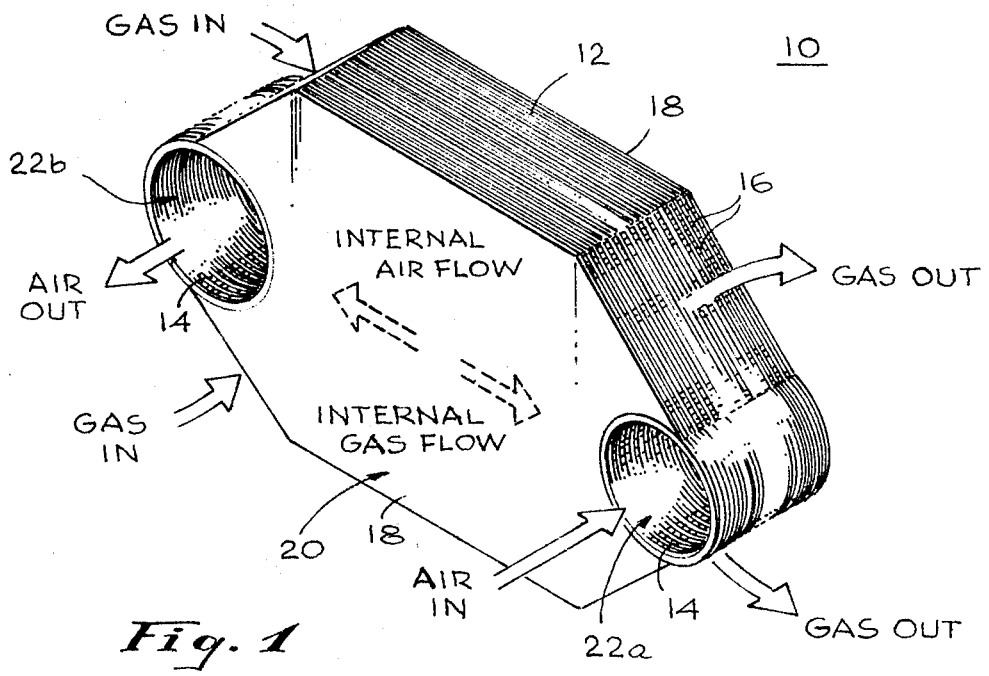
FIG. 1 is a diagrammatic view in perspective of a heat exchanger core section with which apparatus of the present invention is associated.

FIG. 1 illustrates a brazed regenerator core as utilized in heat exchangers of the type discussed hereinabove. The unit 10 of FIG. 1 is but one section of a plurality (for example, six) designed to be assembled in an overall heat exchanger module. The core section 10 comprises a plurality of formed plates 12 interleaved with fins, such as the air fins 14 and the gas fins 16, which serve to direct the air and exhaust gas in alternating adjacent counterflow passages for maximum heat transfer. Side plates 18, similar to the inner plates 12 except that they are formed of thicker sheets, are provided at opposite sides of the core section 10. When assembled and brazed to form an integral unit, the formed plates define respective manifold passages 22*a* and 22*b* at opposite ends of the central counterflow heat exchanging section 20 and communicating with the air passages thereof.

As indicated by the respective arrows in FIG. 1, heated exhaust gas from an associated turbine enters the far end of the section 10, flowing around the manifold passage 22*b*, then through the gas flow passages in the central section 14 and out of the section 10 on the near side of FIG. 1, flowing around the manifold 22*a*. At the same time, compressed air from the inlet air compressor for the associated turbine enters the heat exchanger section 10 through the manifold 22*a*, flows through internal air flow passages connected with the manifolds 22*a*, 22*b* through the central heat exchanging section 20, and then flows out of the manifold 22*b* from whence it is directed to the burner and associated turbine (not shown). In the process the exhaust gas gives up substantial heat to the compressed air which is fed to the associated turbine, thereby considerably improving the efficiency of operation of the regenerated turbine system.

Heat exchangers made up of core sections such as the section 10 of FIG. 1 are provided in various sizes for regenerated gas turbine systems in the range of 5000 to 100,000 hp. In the operation of a typical system employing a regenerating heat exchanger of this type, ambient air enters through an inlet filter and is compressed to form 100 to 150 psi, reaching a temperature of approximately 500° to 600° F. in the compressor section of the gas turbine. It is then piped to the heat exchanger core where the air is heated to about 950° F. by the exhaust gas from the turbine. The heated air is then returned to the combustor and turbine sections of the associated engine via suitable piping. The exhaust gas from the turbine is at approximately 1000° F. and essentially ambient pressure. The exhaust gas drops in temperature to about 600° F. in passing through the core section 10 and is then discharged to ambient through an exhaust stack. In effect, the heat that would otherwise be lost is transferred to the turbine inlet air, thereby decreasing the amount of fuel that must be consumed to operate the turbine. For a 30,000 hp turbine, the regenerator heats 10 million pounds of air per day in normal operation.

The regenerator is designed to operate for 120,000 hours and 5,000 cycles without scheduled repairs, a lifetime of 15 to 20 years in conventional operation. This requires a capability of the equipment to operate at gas turbine exhaust temperatures of 1100° F. and to start as fast as the associated gas turbine so there is no requirement for wasting fuel to bring the system on line at stabilized operating temperatures. It will be understood that prior art heat exchanger structures are directed more for continuous operation of the regenerated turbine system. Thus, such systems have been able to tolerate the additional time and fuel consumption required to bring such a heat exchanger up to stabilized operating temperatures on a gradual basis and to cool the unit down at such time as the turbine is being shut down. However, the current procedures of operating regenerated turbines on a cyclic start-stop basis render obsolete the special start-up and shutdown regimes formerly required to accommodate the limitations of the heat exchanger.

Certain regimes must be followed during the start-up and shutdown of the turbine to accommodate the limitations of the turbine structure during these transitional phases. Thus, when a turbine is being started, it is first brought to approximately 20% of operating speed, at which time the combustor is lit off. Thereafter, under a controlled program, the turbine is eventually brought up to speed. A similar program is followed during shutdown. It is important from the operating standpoint of the overall regenerated turbine system that the heat exchanger included therein be capable of accommodating to the regime dictated by the limitations of the turbine structure. The use of the thin formed plates, fins and other components making up the brazed regenerator core section such as the section 10 of FIG. 1 contribute to this capability. However, provision must be made to insure that the acceptable load limits of the various portions of the heat exchanger core section where thermal stresses may be concentrated or where the structure may be weaker than at others are not exceeded.

The overall heat exchanger core, comprising six core sections 10 in tandem, experiences substantial growth in all three directions, axial as aligned with the manifolds 22*a*, 22*b*, and vertical and horizontal in the lateral plane orthogonal to the axial direction, due both to the considerable size of the heat exchanger and to the substantial temperature ranges encountered in cyclic operation of the overall system. The various elements of the heat exchanger core are brazed together in an arrangement which affords self-containment of the internal pressure forces in the region of fin reinforcement of the pressurized tube plates. However, the portions of the heat exchanger which are not reinforced by the internal fin construction, notably the outer or arch portions of the integral manifolds, are held together by brazed joints and reinforcing hoops. The brazed joints are relatively weak when placed in tension, even though reinforced, and it is desirable to place a preloading force on the manifold portions of the core which can serve to limit the maximum tension forces encountered by the manifold during all possible conditions of system operation. In accordance with the present invention, a bellows coupling arrangement is provided between the external air ducting and the associated manifolds which accommodates the thermal growth, not only of the heat exchanger core but of external restraining structure, and the effects of variations in temperature and pressure in the coupling members themselves in a manner which controls the load applied to the core by the couplings within acceptable limits.

Figure 2:
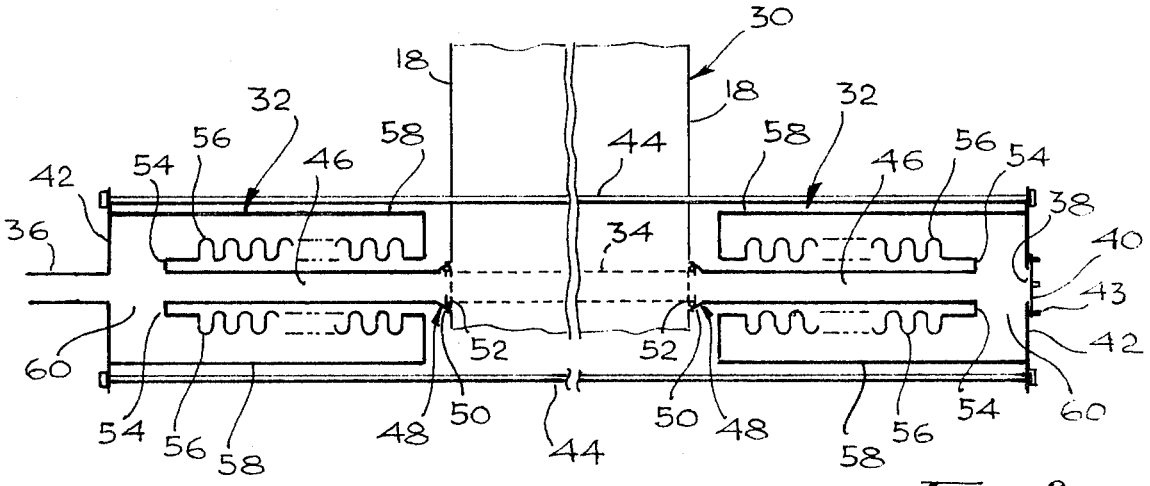
FIG. 2 is a representative block diagram illustrating apparatus in accordance with the present invention.

FIG. 2 illustrates schematically an arrangement including the present invention and shows one-half of a heat exchanger core 30 with associated coupling bellows 32 connected to a manifold 34 extending through the heat exchanger core 30. It will be understood that FIG. 2 shows only one-half of a heat exchanger core and coupling arrangement—for example the air inlet side of FIG. 1—and that another such arrangement including a pair of bellows such as 32 would be provided in conjunction with the other half, such as the air outlet side.

The bellows 32 on the left-hand side of FIG. 2 has an external passage 36 for coupling to the associated air inlet or air outlet ducts of the system. However, the right-hand bellows 32 of FIG. 2 has a corresponding opening 38 which is covered by a manhole 40 secured to the end flange 42 by suitable fastening bolts 44. The flanges 42 are tied together across the entire structure by tie rods 44, and these contain the balanced pressure forces developed by the internal pressure multiplied by the communicating area through the core. It will be appreciated, however, that these tie rods 44 extend through the hot exhaust gas chambers at the gas inlet and outlet ends of the core section 10 as shown in FIG. 1, and therefore experience a fair amount of longitudinal thermal growth themselves which must be taken into account in the load balancing and control arrangements of the present invention.

Each bellows 32 further comprises a central duct 46 joined at its inboard or core end to the adjacent side plate 18 by a coupler 48 comprising a coupling 50 and an internal resilient sealing member 52. At its outboard end, the duct 46 is joined via a re-entrant portion 54 to a bellows section 56. It will be understood that the bellows 32 and the components thereof are circumferential in shape and that they are depicted in FIG. 2 in section. The other, inner end of the bellows section 56 is joined to the external housing 58 of the bellows 32. The region between the bellows section and the housing 58 communicates with the interior of the duct 46 via an annular opening 60, thereby being pressurized at the pressure of the internal air passages of the associated heat exchanger core carrying inlet air to an associated turbine, these pressures commonly falling in an approximate range of 100 to 150 psi, depending on the particular turbine with which the heat exchanger is associated. In the arrangement in accordance with the invention as represented in FIG. 2, the bellows 32 on opposite sides of the heat exchanger core are identical in design parameters in order to achieve the desired balancing of the load forces supplied to the heat exchanger core by the bellows. The bellows 32 on the left-hand side of FIG. 2 is the duct-side bellows, whereas the bellows 32 on the right-hand side of FIG. 2 is a blind duct or manway bellows which, in actual structure of the type described, is closed off with a removable manhole cover 40 to permit access to the interior of the heat exchanger core for inspection and maintenance.

Figure 3:
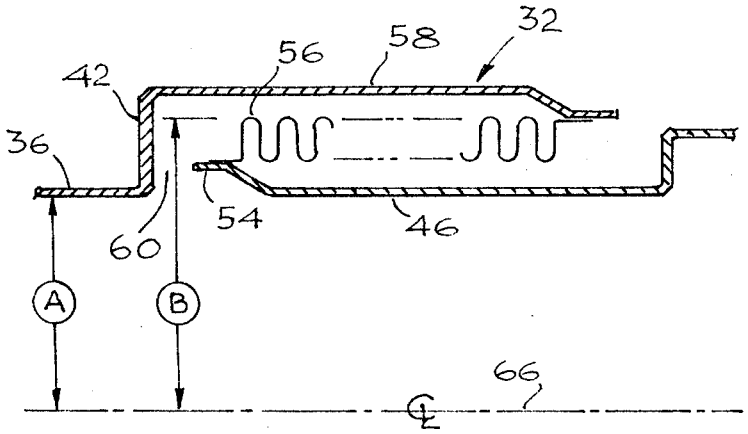
FIG. 3 is a diagrammatic view representing an externally pressurized bellows utilized in accordance with the present invention.

The diagram of FIG. 3 is provided to illustrate the principles of the invention and the design considerations which are applicable in arriving at the structural dimensions of the bellows loading arrangement. As shown in FIG. 3, the portion of the bellows 32 depicted therein can be considered a surface of revolution which, when rotated about the center line 66, develops the cylindrical bellows structure. The elements depicted in FIG. 3 have been given reference numerals corresponding to the bellows structure shown in FIG. 2. Thus there are depicted the housing 58, the bellows section 56, the internal duct 46, the re-entrant portion 54, the opening 60 for external pressurization and the external connecting duct 36. The view in FIG. 3 corresponds to the left-hand bellows 32 of FIG. 2, the core being to the right side of FIG. 3. A mirror image of this view would correspond to the blind duct or manway bellows 32 to the right of FIG. 2.

In the heat exchangers described hereinabove employing particular arrangements in accordance with the invention, the flange 42 of the air duct connection side is fixedly attached to the cold frame structure of a heat exchanger (not shown). Thus, the thermal growth of the tie rods 44 encountered during operation of the heat exchanger develops axial displacement to the right, i.e. displacement of the core and bellows coupling members to the right of the left-hand flange 42 which are capable of such displacement. Initially, the bellows section 56 is placed under tension, which means that a corresponding compressive force is applied to the core by virtue of the re-entrant portion 54 and the anchoring of the bellows section 56 as shown between the rigid housing 58 and the end panel duct 46. The axial force applied between opposed flanges 42 is a function of the operating pressure and the communicating area corresponding to the interior diameter which is twice the radius dimension A and is sometimes referred to as the blow-off load. The effective load on the core applied by the bellows 32 resulting from the pressurization of the system corresponds to the product of the pressure times the annular area of the bellows, which area may be derived by calculating the area corresponding to the radius dimension B and substracting the communicating area corresponding to the radius dimension A. The effective annular area may be varied, as desired, by varying the height of the convolutions of the bellows section 56. The height of the convolutions of the bellows section 56, and thereby the effective annular area, is selected to determine the axial pressure load applied to the core and is preferably chosen to place the core in compression under all operating conditions, or at least to insure that any tension load on the core at any point about the periphery of the manifold does not exceed the maximum tension capability of that particular point at any operating condition of the system.

The load on the core from the bellows 32 in arrangements in accordance with the present invention is made up of three contributing factors. The major factor is the pressure load resulting from the product of the annulus area times the contained air pressure. This accounts for approximately 80 to 90% of the load. The second factor is the axial growth of the bellows due to the relative thermal expansion as the bellows heats up along with the remainder of the hot structure. This accounts for approximately 5% of the total load. Finally, there is a factor of load from lateral movement due to thermal growth of the core in the lateral direction. This develops a bending moment on the core generally manifested about a diametral axis of the adjacent manifold oriented approximately 45° to the orthogonal diameters of the manifold in the lateral plane (i.e. the plane of the core plates). This bending moment force is approximately 10 to 15% of the core load developed by the bellows and can be considered as positive (compressive) load on one side and negative (tension) load on the other.

In accordance with an aspect of the invention, the bellows are installed in a pre-load condition. A slight axial compressive load is applied to the core, resulting from the bellows section being maintained in a slight tension. Also, the axis of the bellows is angled slightly, relative to the manifold axis, the direction of the angle being against the direction of lateral growth of the core. Thus, as the core grows laterally due to thermal expansion, the relative angle diminishes to zero and then increases in the opposite direction, so that the lateral load component goes from positive to negative. This advantageously helps to reduce the lateral forces which are necessarily applied to the core by the bellows, and also increases the fatigue life of the bellows. This results from the fact that cycling the heat exchanger in start-stop operation develops an alternating lateral load between the bellows and the core, rather than variations in magnitude of a uni-directional lateral load which would be greater in amplitude at their upper limit.

As previously noted, as installed, the bellows section 56 is in slight tension which contributes a compressive load to the core. With the lateral pre-load, also applied, there may be some offsetting of the axial compressive load along one portion of the manifold periphery which may result in a slight net tension in the core along that portion. When the turbine and compressor are started up, pressure begins to build up in the air passages and is applied to the outside of the bellows section 56. This causes the bellows to shrink slightly, increasing the compressive load on the core. This is counteracted slightly from axial growth of the bellows which develops a component in the opposite direction to that developed by the pressurization. As a startup regime is continued with the combustor being lit off and the turbine brought to full operating condition in accordance with its control program, the opposed bellows coupling arrangement of the invention accommodates the thermal growth of the core and other heated components in the load support loop while balancing the internal pressure forces and maintaining the loads on the core within acceptable limits. When the turbine is being shut down, the pressure generally follows the temperature, thus varying the applied loads within the design limits of the core, as determined in designing the bellows.

One method of designing externally pressurized bellows for use in arrangements in accordance with the present invention involve the determination of all forces about the load support loop including the core, the bellows, the end flanges and tie rods for all anticipated phases of operation from startup to shutdown. The mean annulus area of the bellows is then selected to develop the appropriate pressure force to maintain the compressive force on the core within acceptable limits. Further, during installation, the bellows and core are mounted relative to each other with a preselected axial and lateral pre-load to take account of changes in structure dimensions occurring during operation.

In determining the particular design parameters for the bellows, the values of loading due to pressure, axial growth, and lateral movement are added algebraically for all anticipated conditions, and the maximum compression and maximum tension that can occur, regardless of how the core and related structure move, are calculated. The convolution height of the bellows section 56, and thereby the mean annulus area, is then selected to insure that the maximum compressive load and maximum tension on the core as thus calculated is within acceptable limits for the core design.

In one particular embodiment of the invention, a bellows coupling structure was provided for use with a heat exchanger core in a system such as is represented schematically in FIGS. 2 and 3 with the following design parameters:

| | |
|---|---|
| Cycle Life | 5,000 cycles |
| Design Pressure | 155 psig |
| Design Temperature | 1,000° F. |
| Axial Extension Movement | 2.375 inches |
| Axial Compression Movement | 1.4 inches |
| Lateral Deflection | ± 0.27 inch |
| Angular Rotation | 0° |
| Axial Rate | 500 lbs. per inch |
| Lateral Rate | 2000 lbs. per inch |
| Dimension A (FIG. 3) | 11.875 inches |
| Dimension B (FIG. 3) | 14.0 inches |
| Length of Bellows | |
| Overall length (FIG. 3) | 25 inches |
| Bellows Section | 13 inches |

These design parameters were developed in a bellows with an effective annulus area of 565.36 sq. inches.

As a result of the use of the flexible externally pressurized metal bellows for coupling and supporting duct loads relative to a heat exchanger core, the core is given complete freedom to move without constraint within its acceptable load limits, thus preventing damage which might otherwise result from thermally induced stresses. The blind ducts provided on the opposite side of the core from the associated air ducts serve to balance the loads supplied to the opposite sides of the core and, together with the external tie rod members, serve to react the blow-off loads which tend to extend the bellows axially under pressure. The combination of external pressurization of the bellows with controlled compression load on the core accomplishes these results with a very soft bellows configuration (i.e., low spring rate) without instability and within the very low force levels acceptable to the core.

Although there have been shown and described herein particular methods and apparatus for isolation of external loads in a heat exchanger manifold system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Apparatus for coupling air ducting to the integral manifold of a thin plate-and-fin heat exchanger core which is susceptible to thermal growth during operation, comprising:

an externally pressurized bellows coupled between an associated external air duct and a manifold passage, the bellows having a selected annulus area capable of developing, when pressurized at operating pressures of the system, a pressure-times-area force sufficient to maintain a compressive load on the core for all operating conditions.

2. The apparatus of claim 1 further comprising a similar bellows on the opposite side of the core from the first-mentioned bellows for coupling a blind duct to the opposite end of the manifold from the air duct for balancing the forces on the manifold portions of the core.

3. The apparatus of claim 2 wherein each of said bellows is coupled to a corresponding flange member, and further comprising a plurality of tie rods extending across the core between said flange members for containing the blow-off loads of the core.

4. The apparatus of any one of claims 1–3 wherein each said bellows is pre-loaded at installation in slight axial tension to establish a component of axial compressive loading on the core.

5. The apparatus of any one of claims 1–3 wherein upon installation each bellows is mounted with a selected lateral pre-load on the core.

6. The apparatus of claim 5 wherein the selected lateral pre-load is in a direction opposite to the direction of lateral growth of the core resulting from thermal expansion at operating temperatures.

7. The apparatus of claim 3 wherein said similar bellows is free to move axially with the core through the extent of elongation of the tie rods resulting from the heating thereof.

8. The method of sizing a bellows coupling member provided for coupling an air duct to the integral manifold portion of a thin plate-and-fin heat exchanger which includes a plurality of tie rods and opposed flanges for containing the blow-off forces comprising:

determining the displacement due to axial and lateral growth during all potential operating conditions of all members subject to such displacement in a load support system including the bellows;

combining said values to determine the maximum forces which can be applied to the core, regardless of core movement;

comparing said values with the maximum values which can be accommodated by the core; and selecting an annulus area of the bellows sufficient to develop a predetermined pressure load within acceptable limits of said forces.

9. The method of coupling an air duct to a heat exchanger core constructed of stacked thin formed plates and fins brazed together in a core structure having integral air manifolds, comprising the steps of:

selecting a bellows of a predetermined annulus area for developing a desired pressure load on the core to maintain the core manifolds in compression during normal operating conditions; and applying a predetermined axial pre-load in compression on the core as installed.

10. The method of claim 9 further comprising applying a predetermined lateral pre-load on the core corresponding to anticipated lateral thermal growth of the core during operation.

11. The method of claim 10 wherein the step of applying lateral pre-load includes applying the lateral pre-load in the direction of anticipated thermal growth of the core.

12. The method of any one of claims 9–11 further comprising the step of coupling a pair of bellows to opposite sides of a core manifold in order to balance the forces applied to opposite sides of the core.

13. The method of claim 12 further comprising the step of coupling a closed end bellows to the side of the core remote from the side of the core which is coupled to an associated air duct.

* * * * *